US011090936B2

(12) United States Patent
Hayashi

(10) Patent No.: US 11,090,936 B2
(45) Date of Patent: Aug. 17, 2021

(54) LIQUID DISCHARGING HEAD

(71) Applicant: Brother Kogyo Kabushiki Kaisha, Nagoya (JP)

(72) Inventor: Hideki Hayashi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/910,887

(22) Filed: Jun. 24, 2020

(65) Prior Publication Data

US 2020/0406618 A1 Dec. 31, 2020

(30) Foreign Application Priority Data

Jun. 28, 2019 (JP) ..... JP2019-121275

(51) Int. Cl.
*B41J 2/14* (2006.01)
*B41J 2/155* (2006.01)

(52) U.S. Cl.
CPC ..... *B41J 2/1429* (2013.01); *B41J 2/155* (2013.01); *B41J 2002/14306* (2013.01); *B41J 2202/21* (2013.01)

(58) Field of Classification Search
CPC ..... B41J 2/1429; B41J 2/155; B41J 2002/21; B41J 2002/14306
See application file for complete search history.

(56) References Cited

U.S. PATENT DOCUMENTS 8,480,222 B2 7/2013 Nishikawa et al.
2008/0012915 A1* 1/2008 Ishizawa ..... B41J 2/17513 347/86
2011/0085012 A1 4/2011 Nishikawa et al.
2015/0258788 A1* 9/2015 Togashi ..... B41J 2/14233 347/65

FOREIGN PATENT DOCUMENTS

JP 2009-178649 A 8/2009
JP 2011-079251 A 4/2011
JP 2013-099741 A 5/2013
JP 2016-159514 A 9/2016

* cited by examiner

*Primary Examiner* — Lamson D Nguyen
(74) *Attorney, Agent, or Firm* — Banner & Witcoff, Ltd.

(57) ABSTRACT

A liquid discharging head, having individual flow paths, a first manifold, a second manifold, a third manifold, a connecting flow path, and a bypass, is provided. The first manifold extends in a first direction and is provided commonly to the individual flow paths. The second manifold and the third manifold are located on one side and the other side of the first manifold in a second direction. The second manifold and the third manifold are provided commonly to a part of the individual flow path and another part of the individual flow path, respectively. The connecting flow path partly overlaps the first manifold in a vertical direction and connects one end of the second manifold and one end of the third manifold on one side in a third direction. The bypass extends in the vertical direction and connects the first manifold and the connecting flow path.

11 Claims, 9 Drawing Sheets

LIQUID DISCHARGING HEAD

CROSS REFERENCE TO RELATED APPLICATION

This application claims priority from Japanese Patent Application No. 2019-121275, filed on Jun. 28, 2019, the entire subject matter of which is incorporated herein by reference.

BACKGROUND

Technical Field

An aspect of the present disclosure is related to a liquid discharging head for discharging liquid through discharging openings.

Related Art

A liquid discharging head for discharging ink is known. The liquid discharging head may have a plurality of nozzle arrays, each of which includes a plurality of nozzles arrayed in one direction. The plurality of nozzles may each be continuous with one of a plurality of individual flow paths, which each includes a supplying path, a pressure chamber, and a communication path. Liquid may be supplied to the individual flow paths through common supplying paths (also called as "supplying manifolds") and collected through a common collecting path (also called as "returning manifold"). The supplying manifolds and the returning manifold may extend along the same one direction as the arrayed direction for the plurality of nozzles. The supplying manifolds may each be provided to one of the nozzle arrays. Meanwhile, the returning manifold may be provided commonly to two (2) of the nozzle arrays that adjoin each other side by side along an orthogonal direction, which intersects orthogonally with the one direction. In other words, two (2) supplying manifolds may be provided to two (2) nozzle arrays, and one (1) returning manifold may be provided to the same two (2) nozzle arrays. The returning manifold may be arranged between the two supplying manifolds for the adjoining two nozzle arrays.

SUMMARY

In the liquid discharging head, as the liquid is delivered from a liquid source to the individual flow paths, air may be mixed in the liquid. Moreover, due to, for example, deficiencies in the discharging channels, air entering through the discharging openings may flow reversely to be mixed in the liquid. The air mixed in the liquid may retain in the supplying manifolds and accumulate. In the liquid discharging head, in which two (2) supplying manifolds and one (1) returning manifold are provided to two (2) nozzle arrays, amounts of the air to retain in the two supplying manifolds may differ due to, for example, differences in configurations of the flow paths between the liquid source and the supplying manifolds and/or a number of the discharging channels with defects. The different amounts of the air accumulated in the supplying manifolds may cause a difference between amounts of the liquid to be supplied from the supplying manifolds to the individual flow paths even under the same control to supply the same amount of the liquid to the individual flow paths. Similarly, a difference may be caused in the amounts of the liquid to be supplied between two different individual flow paths that are continuous with the same supplying manifold.

The present disclosure is advantageous in that a liquid discharging head, capable of reducing a difference in amounts of the air to be accumulated between two (2) manifolds that are provided for different individual flow paths, is provided.

According to an aspect of the present disclosure, a liquid discharging head, having a plurality of individual flow paths, a first manifold, a second manifold, a third manifold, a connecting flow path, and a bypass, is provided. Each of the plurality of individual flow paths includes a discharging opening for discharging liquid. The first manifold extends in a first direction, which intersects with a vertical direction. The first manifold is provided commonly to the plurality of individual flow paths. The second manifold is located on one side of the first manifold in a second direction, which intersects orthogonally with the first direction. The second manifold extends in a third direction, which intersects with the vertical direction and the second direction. The second manifold is provided commonly to a part of the plurality of individual flow paths. The third manifold is located on the other side of the first manifold opposite to the one side in the second direction. The third manifold extends in the third direction. The third manifold is provided commonly to another part of the plurality of individual flow paths. The connecting flow path partly overlaps the first manifold in the vertical direction. The connecting flow path connects one end of the second manifold on one side in the third direction and one end of the third manifold on the one side in the third direction. The bypass extends in the vertical direction. The bypass has an inlet flow path, through which the liquid enters, at a lower end thereof, and an outlet flow path, through which the liquid exits, at an upper end thereof. The bypass connects the first manifold and the connecting flow path.

BRIEF DESCRIPTION OF THE ACCOMPANYING DRAWINGS

DETAILED DESCRIPTION

In the flowing paragraphs, with reference to the accompanying drawings, an embodiment of the present disclosure will be described.

<Overall Configuration of Printer>

Figure 1:
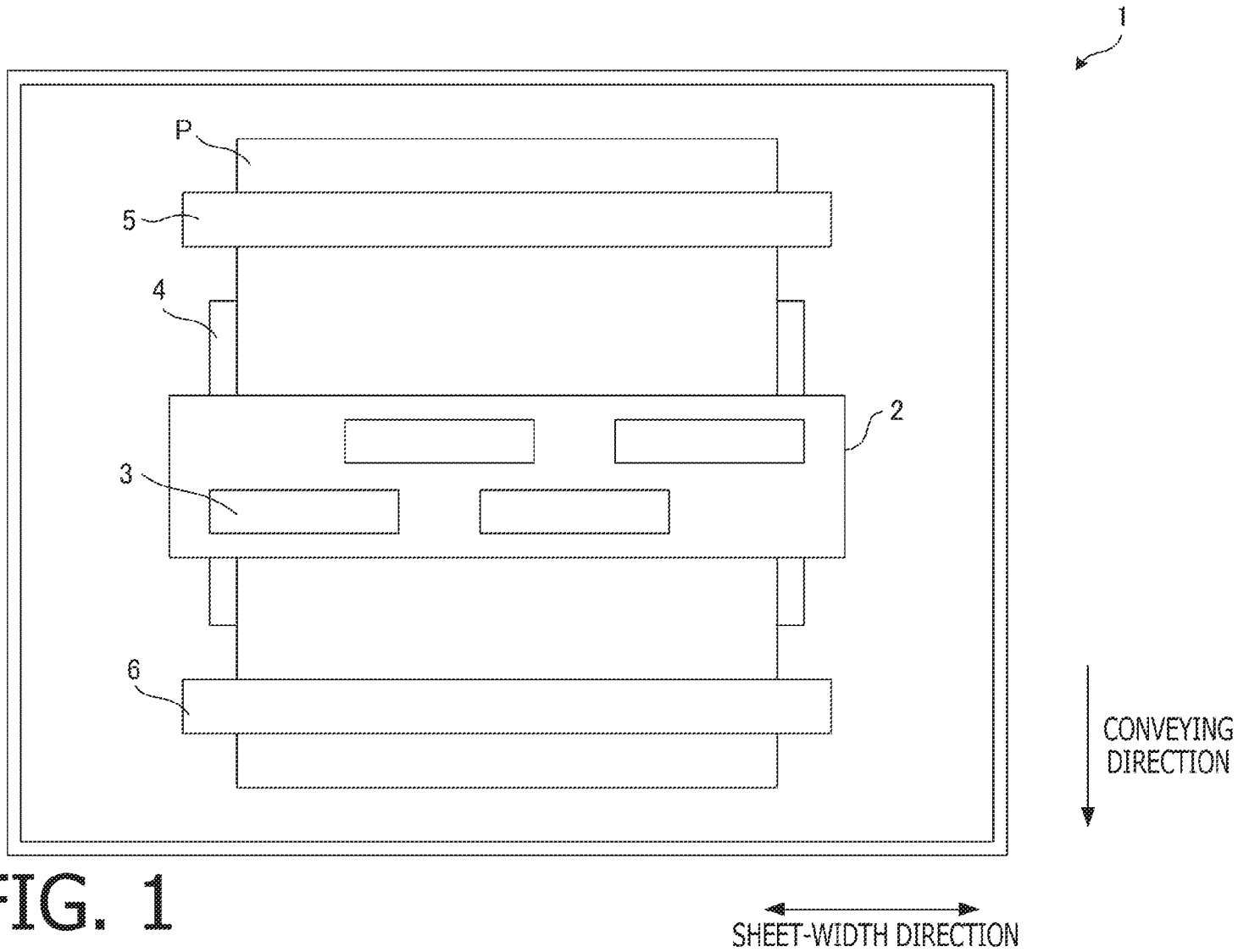
FIG. 1 is a plan view of a printer having an inkjet head according to an embodiment of the present disclosure.

As shown in FIG. 1, a printer 1 according to the embodiment of the present disclosure has a head unit 2, a platen 4, and conveyer rollers 5, 6. The head unit 2 may include four (4) ink jet heads 3.

The platen 4 may support a recording sheet P from below. The conveyer rollers 5, 6 to convey the recording sheet P are arranged on one side, e.g., an upstream side, and the other side, e.g., a downstream side, of the platen 4 in a conveying direction, which is from up to down in FIG. 1.

The head unit 2 extends longitudinally in a sheet-width direction, which intersects orthogonally with the conveying direction, and is arranged at an upper position with respect to the platen 4. The head unit 2 may be a line-printing inkjet head capable of discharging ink at the recording sheet P through discharging openings (see FIGS. 2 and 3) while being situated at a fixed position. The inkjet heads 3, each extending longitudinally in the sheet-width direction, are arrayed alternately in zigzag along the sheet-width direction.

<Inkjet Heads>

Figure 2:
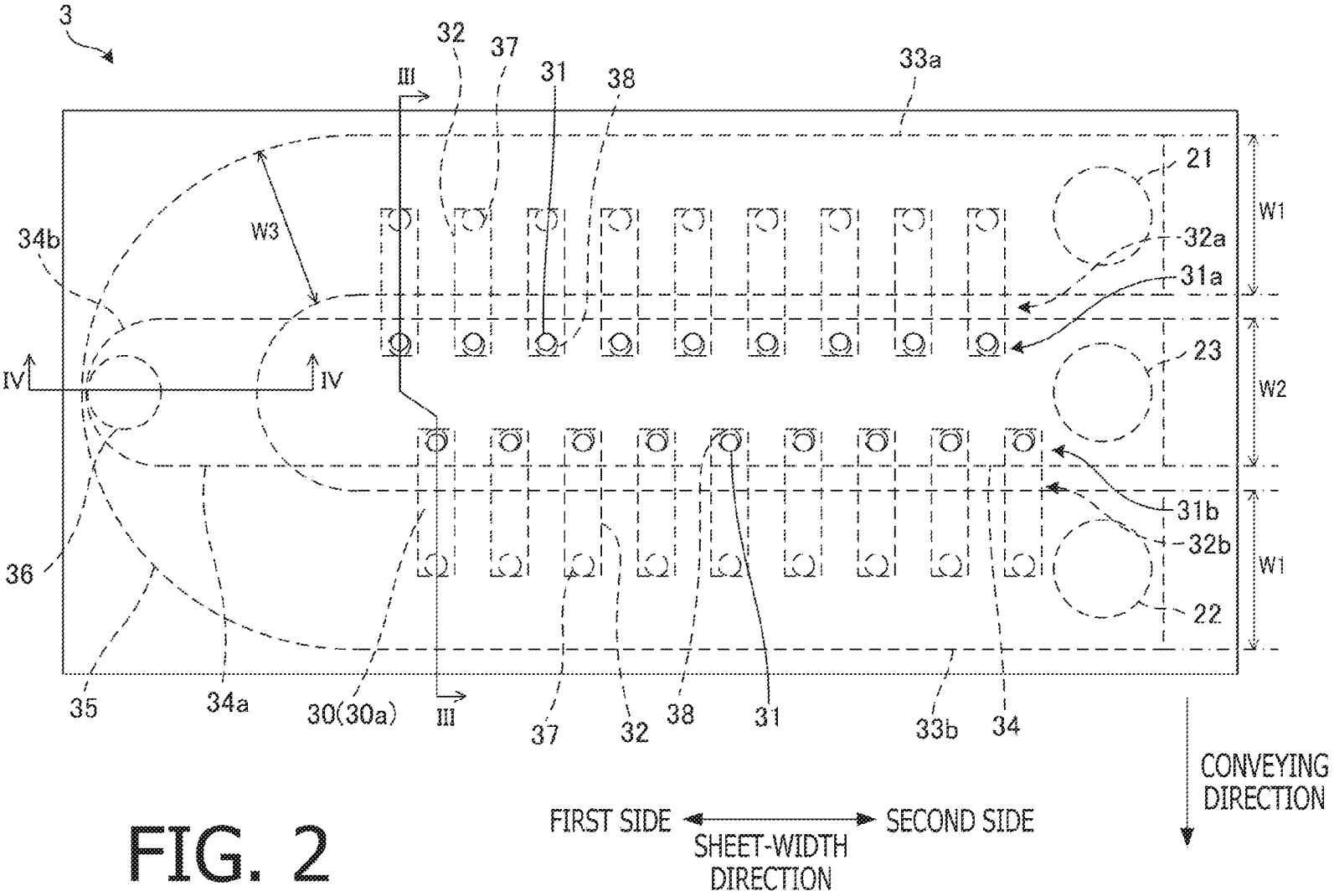
FIG. 2 is a bottom plan view of the inkjet head according to the embodiment of the present disclosure.
Figure 3:
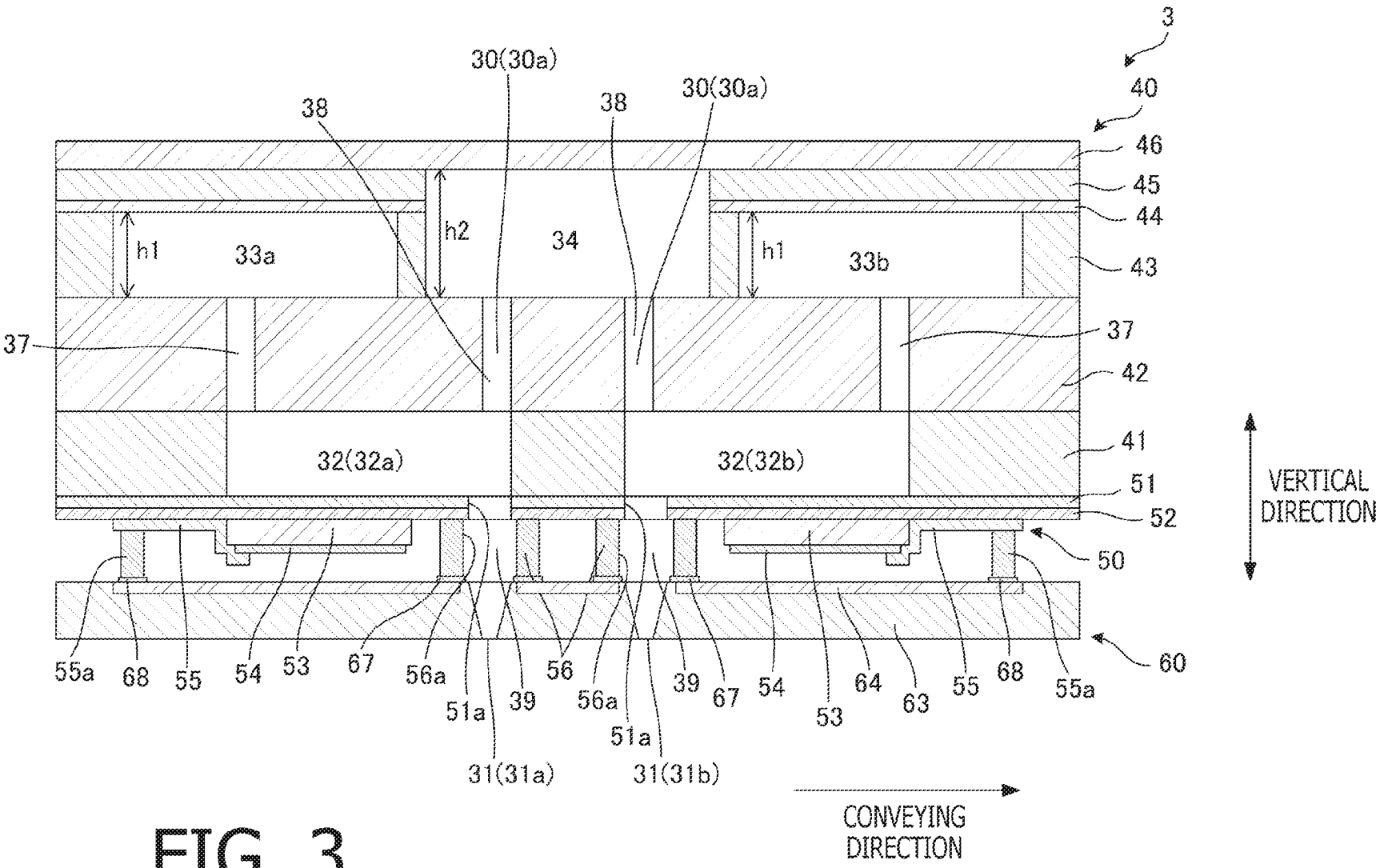
FIG. 3 is a cross-sectional view of the inkjet head according to the embodiment of the present disclosure viewed along a line III-III shown in FIG. 2.

Next, with reference to FIGS. 2-4, one of the inkjet heads 3 will be described representatively in detail. The inkjet head 3 has, as shown in FIG. 2, a rectangular shape elongated in the sheet-width direction in the bottom plan view. The inkjet head 3 includes, as shown in FIG. 3, a flow path unit 40, an actuator 50, and a nozzle unit 60. The flow path unit 40, the actuator 50, and the nozzle unit 60 arranged from top to bottom in this given order. On a lower face of the nozzle unit 60, a plurality of discharged openings 31 are arranged.

The inkjet head 3 includes a plurality of individual flow paths 30, two (2) supplying manifolds 33*a*, 33*b*, a returning manifold 34, a connecting flow path 35, and a bypass 36. Each of the plurality of individual flow paths 30 has a discharging opening 31. The connecting flow path 35 connects the supplying manifold 33*a* and the supplying manifold 33*b*. The bypass 36 connects the returning manifold 34 and the connecting flow path 35. The supplying manifolds 33*a*, 33*b* may supply ink to the individual flow paths 30. The ink flowing from the supplying manifolds 33*a*, 33*b* and through the individual flow paths 30 may further flow into the returning manifold 34. In other words, the returning manifold 34 may accept the ink flowing from the supplying manifold 33*a* and from the supplying manifold 33*b*.

As shown in FIG. 3, the flow path unit 40 is formed of six (6) plates 41, 42, 43, 44, 45, 46, which are layered in this given order from bottom to top. The plates 41-46 each have a rectangular shape elongated in the sheet-width direction in the bottom plan view.

The plate 41 is formed to have a plurality of through holes, each of which constitutes one of a plurality of pressure chambers 32. As shown in FIG. 2, the plurality of pressure chambers 32 are arrayed to form two (2) pressure chamber arrays 32*a*, 32*b*. The pressure chambers 32 forming the pressure chamber arrays 32*a*, 32*b* are arrayed at equal intervals along the sheet-width direction. The pressure chamber arrays 32, 32*b* align side by side along the conveying direction. The pressure chamber array 32*a* is located on an upstream side, e.g., an upper side in FIG. 2, of the pressure chamber array 32*b* in the conveying direction. The pressure chambers 32 are arranged alternately in zigzag so that each pressure chamber 32 is located at a different position in the sheet-width direction.

The plate 42 is formed to have a plurality of through holes, each of which constitutes one of supplying flow paths 37 or one of returning flow paths 38. Each pressure chamber 32 is provided with one of the supplying flow paths 37 and one of the returning flow paths 38. The supplying flow paths 37 are flow paths to convey the ink to the pressure chambers 32 from the supplying manifolds 33*a*, 33*b* and are each connected to an upper end of the respective one of the pressure chambers 32. The returning flow paths 38 are flow paths to convey a part of the ink in each pressure chamber 32 to the returning manifold 34 and are each connected to an upper end of the respective one of the pressure chambers 32.

In particular, to the pressure chambers 32 belonging to the pressure chamber array 32*a*, the supplying flow paths 37 are connected at an upstream end area, and the returning flow paths 38 are connected at a downstream end area in the conveying direction, in each of the pressure chambers 32. On the other hand, to the pressure chambers 32 belonging to the pressure chamber array 32*b*, the supplying flow paths 37 are connected at a downstream end area, and the returning flow paths 38 are connected at an upstream end area in the conveying direction, in each of the pressure chambers 32. In this regard, each individual flow path 30 consists of, but not is limited to, the pressure chamber 32, the supplying flow path 37, the returning flow path 38, and a discharging flow path 39 which is described later.

Figure 4:
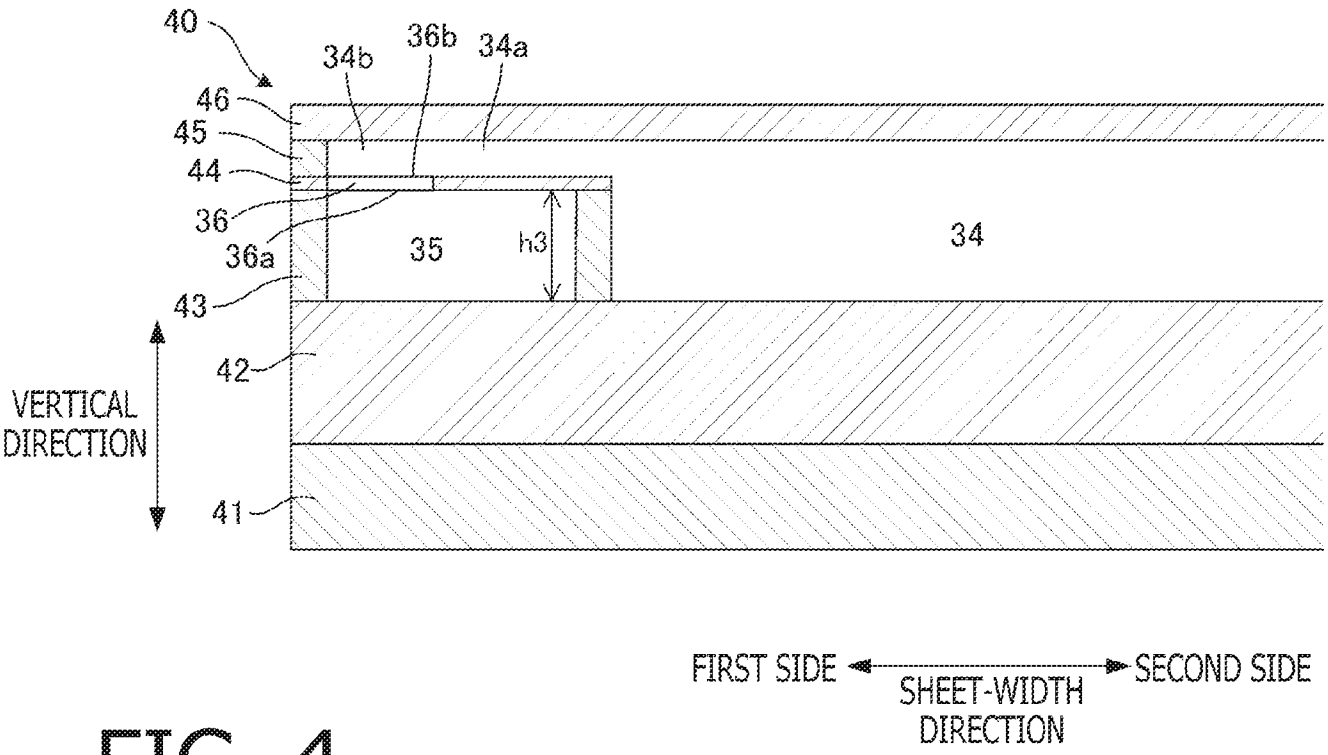
FIG. 4 is a cross-sectional view of a flow path unit according to the embodiment of the present disclosure viewed along a line IV-VI shown in FIG. 2.

As shown in FIGS. 3 and 4, the plate 43 is formed to have through holes, which constitute the supplying manifolds 33*a*, 33*b* and the connecting flow path 35, and through hole, which constitutes a part of the returning manifold 34. The returning manifold 34 consists of, not only the through hole formed in the plate 43, but also of through holes formed in the plate 44 and the plate 45. In other words, the returning manifold 34 is formed through the plate 43, the plate 44, and the plate 45. Meanwhile, lower ends of the supplying manifolds 33*a*, 33*b* are defined by an upper face of the plate 42. A depth h1 of the supplying manifolds 33*a*, 33*b*, i.e., a length in the vertical direction, is equal to a depth h3 of the connecting flow paths 35 and smaller than a depth h2 of the returning manifold 34.

The returning manifold 34 extends, as shown in FIG. 2, longitudinally in a direction intersecting orthogonally with the vertical direction, i.e., in the sheet-width direction, in a central area in the inkjet head 3 in the conveying direction. While in FIG. 2 a first side and a second side in the sheet-width direction correspond to a leftward side and a rightward side, respectively, to a viewer, the returning manifold 34 is connected with a returning port 23 in an end area thereof on the second side in the sheet-width direction, i.e., a rightward end area in FIG. 2. The returning port 23 is open upward through the upper face of the flow path unit 40, and the ink may flow through the returning port 23 to exit the returning manifold 34. The ink in the returning manifold 34 may flow along the sheet-width direction. In other words, a flowing direction for the ink in the returning manifold 34 is a direction along the sheet-width direction.

At an end on the first side of the returning manifold 34 in the sheet-width direction, i.e., a leftward end in FIGS. 2 and 4, a protrusive portion 34*a* to protrude in the sheet-width direction toward the first side, i.e., leftward, is formed. As will be described further below, the protrusive portion 34*a* overlaps the connecting flow path 35 in the vertical direction. The protrusive portion 34*a* consists of a through hole formed in the plate 45. As shown in FIG. 2, in an end area on the first side in the sheet-width direction, i.e., a leftward end area in FIG. 2, of the returning manifold 34, in other words, at an end area of the protrusive portion 34*a* on the first side in the sheet-width direction, a semicircular portion 34*b* having a semicircular or arched shape in the plan view is arranged. A length of the semicircular portion 34*b* along the conveying direction is, at least in the part of the returning manifold 34 being connected with the bypass 36, smaller toward the end of the returning manifold 34 on the first side, i.e., toward the left, in the sheet-width direction. In other words, the semicircular portion 34*b* is rounded toward the left.

As shown in the bottom plan view in FIG. 2, the returning manifold 34 overlaps a downstream part of each pressure chamber 32 in the conveying direction that forms the pressure chamber array 32*a*, i.e., lower parts of the pressure chambers 32 in the pressure chamber array 32*a* in FIG. 2, and an upstream part of each pressure chamber 32 in the conveying direction that forms the pressure chamber array 32*b*, i.e., upper parts of the pressure chambers 32 in the pressure chamber array 32*b* in FIG. 2. Meanwhile, as shown in FIG. 3, the returning flow paths 38 connected with the pressure chambers 32 that form the pressure chamber array 32*a* are all connected to a lower end of the returning manifold 34. Similarly, the returning flow paths 38 connected with the pressure chambers 32 that form the pressure chamber array 32*b* are all connected to the lower end of the returning manifold 34. In this regard, the returning manifold 34 is provided commonly to the plurality of individual flow paths 30, each of which includes the pressure chamber 32 forming either the pressure chamber array 32*a* or the pressure chamber array 32*b*.

The supplying manifolds 33*a*, 33*b* extend, as shown in FIG. 2, along a direction intersecting orthogonally with the vertical direction and with the conveying direction, i.e., the sheet-width direction. In other words, the supplying manifolds 33*a*, 33*b* and the returning manifold 34 extend in parallel to each other. The supplying manifold 33*a* is located on an upstream side, i.e., an upper side in FIG. 2, of the returning manifold 34 in the direction intersecting orthogonally with the sheet-width direction, i.e., in the conveying direction. The supplying manifold 33*b* is located on a downstream side, i.e., a lower side in FIG. 2, of the returning manifold 34 in the direction intersecting orthogonally with the sheet-width direction, i.e., in the conveying direction.

As shown in FIG. 2, the supplying manifold 33*a* is connected with a supplying port 21 in an end area thereof on the second side in the sheet-width direction, i.e., a rightward end area in FIG. 2; and the supplying manifold 33*b* is connected with a supplying port 22 in an end area thereof on the second side in the sheet-width direction, i.e., a rightward end area in FIG. 2. The supplying ports 21, 22 are open upward through the upper face of the flow path unit 40, and the ink may be supplied to the supplying manifolds 33*a*, 33*b* through the supplying ports 21, 22, respectively. As will be described further below, the ink in the supplying manifolds 33*a*, 33*b* may flow along the sheet-width direction. In other words, a flowing direction for the ink in the supplying manifolds 33*a*, 33*b* is a direction along the sheet-width direction.

As shown in the bottom plan view in FIG. 2, a downstream part, i.e., a lower part in FIG. 2, of the supplying manifold 33*a* in the conveying direction overlaps the upstream parts, i.e., the upper parts in FIG. 2, of the pressure chambers 32 that form the pressure chamber array 32*a*. An upstream part, i.e., an upper part in FIG. 2, of the supplying manifold 33*b* in the conveying direction overlaps the downstream parts, i.e., the lower parts in FIG. 2, of the pressure chambers 32 that form the pressure chamber array 32*b*.

As shown in FIG. 3, the supplying paths 37 connected with the pressure chambers 32 that form the pressure chamber array 32*a* are all connected to a lower end of the supplying manifold 33*a*. In this regard, the supplying manifold 33*a* is provided commonly to the plurality of individual flow paths 30, each of which includes the pressure chamber 32 forming the pressure chamber array 32*a*. The supplying paths 37 connected with the pressure chambers 32 that form the pressure chamber array 32*b* are all connected to a lower end of the supplying manifold 33*b*. In this regard, the supplying manifold 33*b* is provided commonly to the plurality of individual flow paths 30, each of which includes the pressure chamber 32 forming the pressure chamber array 32*b*.

The supplying manifold 33*a* is connected with the returning manifold 34 through the pressure chambers 32, which form the pressure chamber array 32*a*, and through the supplying flow paths 37 and the returning paths 38, which are connected with the pressure chambers 32 forming the pressure chamber array 32*a*. The supplying manifold 33*b* is connected with the returning manifold 34 through the pressure chambers 32, which form the pressure chamber array 32*b*, and through the supplying flow paths 37 and the returning paths 38, which are connected with the pressure chambers 32 forming the pressure chamber array 32*b*.

Each supplying flow path 37, each pressure chamber 32, and each returning flow path 38 that constitute a part of each one of the individual flows 30 form a circulative flow path 38 that connects the supplying manifold 33*a* or the supplying manifold 33*b* with the returning manifold 34. In this regard, the circulative flow path 30*a* is provided to each of the individual flow paths 30, and the circulative flow paths 30*a* connect the supplying manifolds 33*a*, 33*b* with the returning manifold 34 through the individual flow paths 30.

As shown in FIG. 2, the connecting flow path 35 connects ends of the supplying manifolds 33*a*, 33*b* in the sheet-width direction, i.e., leftward ends in FIG. 2. The connecting flow path 35 has, in the plan view, a semicircular or arched shape. As will be described further below, a flowing direction for the ink in the connecting flow path 35 is a direction along a circumferential direction of a semicircle. A length between ends of the connecting flow path 35 in the conveying direction is smaller toward one end of the connecting flow path 35 on the first side in the sheet-width direction, i.e., toward the left. In other words, the connecting flow path 35 is rounded toward the left.

A breadth W3 of the connecting flow path 35 is equal to a breadth W1 of the supplying manifold 33*a* and of the supplying manifold 33*b*. Meanwhile, a breadth W2 of the returning manifold 34 is equal to the breadth W1 and to the breadth W3. In this context, a breadth refers to a dimension in a direction intersecting orthogonally with the vertical direction and with the flowing direction for the ink. In this regard, the breadth W3 is a dimension of the connecting flow path 35 in a radial direction of the semicircle in the plan view, and the breadth W1 of the supplying manifold 33*a*, 33*b* and the breadth W2 of the returning manifold 34 are dimensions in the conveying direction. Meanwhile, the depth h3 of the connecting flow path 35 is equal to the depth h1 of the supplying manifold 33*a* and of the supplying manifold 33*b*. In other words, cross-sectional areas of the connecting flow path 35, the supplying manifold 33*a*, and the supplying manifold 33*b* on planes intersecting orthogonally with the respective flowing directions for the ink are equal.

The connecting flow path 35 overlaps a part of the returning manifold 34 in the vertical direction. In particular, as shown in FIG. 4, the connecting flow path 35 is located at a position lower than the protrusive portion 34*a* of the returning manifold 34.

As shown in FIG. 4, the bypass 36 to connect the returning manifold 34 and the connecting flow path 35 is formed of a through hole, which is formed in the plate 44, and extends in the vertical direction. A cross-sectional area of the bypass 36 on a plane spreading parallel with a horizontal direction is constant at each vertical position. At a lower end of the bypass 36, an inlet flow path 36*a*, through which the ink from the connecting flow path 35 enters the bypass 36, is formed. At an upper end of the bypass 36, an outlet flow path 36*b*, through which the ink exits the bypass 36 to flow into the returning manifold 34, is formed.

As shown in FIG. 2, while the discharging openings 31 array in the sheet-width direction to form two (2) discharging opening arrays 31*a*, 31*b*, the bypass 36 is located farther toward the first side in the sheet-width direction than ends, i.e., leftward ends in FIG. 2, of the discharging opening arrays 31*a*, 31*b* on the first side in the sheet-width direction. The ends, i.e., the leftward ends in FIG. 2, of the supplying manifolds 33*a*, 33*b* in the sheet-width direction, at which the supplying manifolds 33*a*, 33*b* are connected with the connecting flow path 35, are located between the ends, i.e., the leftward ends in FIG. 2, of the discharging opening arrays 31*a*, 31*b* in the sheet-width direction on the first side, and the bypass 36.

As shown in FIGS. 2 and 4, the bypass 36 is connected with an end portion, i.e., the leftward end portion in FIGS. 2 and 4, of the connecting flow path 35 on the first side in the sheet-width direction. The bypass 36 is connected with the semicircular portion 34*b* in the protrusive portion 34*a* at the end of the returning manifold 34 on the first side in the sheet-width direction. A value of potential resistance in the bypass 36 is equal to a value of combined potential resistance of the circulative flow paths 30*a*. For example, when a number of the discharging channels is 864, a diameter of the bypass 36 may be 0.22-0.26 mm, and a length of the bypass 36 may be 0.5-1.0 mm.

As shown in FIG. 3, the actuator 50 includes a vibration board 51, a common electrode 52, piezoelectric devices 53, individual electrodes 54, wires 55, bumps 55*a*, and tubular electrodes 56. The vibration board 51, the common electrode 52, the piezoelectric devices 53, and the individual electrodes 54 are layered in this given order from top to bottom.

As shown in FIG. 3, the vibration board 51 is arranged on a lower face of the flow path unit 40. An exterior shape of the vibration board 51 in the bottom plan view is the same as the shapes of the plates 41-46 that constitute the flow path unit 40, i.e., a rectangular shape elongated in the sheet-width direction. The vibration board 51 covers the lower face of the flow path unit 40 entirely and defines lower ends of the pressure chambers 32. In the meantime, the common electrode 52 covers a lower face of the vibration board 51 entirely, and a lower face of the common electrode 52 is covered by an insulation sheet, which is not shown.

In the vibration board 51 and the common electrode 52, a plurality of through holes 51*a* are formed at positions to each vertically overlap one of the discharging openings 31. Moreover, the through holes 51*a* are each formed at positions to vertically overlap one of the pressure chambers 32. The tubular electrodes 56 each have a cylindrical shape and are formed to have a through hole 56*a*. The tubular electrodes 56 are arranged on the lower face of the common electrode 52 to encircle the through holes 51*a* and are connected electrically with the common electrode 52. The through holes 51*a* and the through holes 56*a* constitute the discharging flow paths 39, which connect the pressure chambers 32 and the discharging openings 31, and through which the ink may flow from the pressure chambers 32 toward the discharging openings 31.

The piezoelectric devices 53 are formed of a piezoelectric material such as, for example, lead zilconate titanate (PZT). The piezoelectric devices 53 are arranged on the lower face of the common electrode 52. The piezoelectric devices 53 are each provided for each of the pressure chambers 32 that constitute the pressure chamber array 32*a* and for the pressure chambers 32 that constitute the pressure chamber array 32*b* at positions corresponding to the respective pressure chambers 32. The individual electrodes 54 are arranged on a lower face of each piezoelectric devices 53 at positions to vertically overlap the pressure chambers 32.

In each piezoelectric device 53, each area interposed between the individual electrode 54 and the common electrode 52 may function as an activating portion, which is deformable in response to voltage applied to the individual electrode 54. In other words, the actuator 50 includes a plurality of activating portions, each of which vertically overlaps one of the pressure chambers 32. As the driving voltage is applied to the individual electrode 54, the activating portion may deform to dent into the pressure chamber 32. Thereby, a volume in the pressure chamber 32 may change, and the ink in the pressure chamber 32 may be pressurized so that the ink may be discharged through the discharging opening 31.

The wires 55 are, as shown in FIG. 3, drawn from the individual electrodes 54 along the conveying direction and electrically connected with the individual electrodes 54 respectively. In particular, the wires 55 to the individual electrodes 54 that are arranged to vertically overlap the pressure chambers 32 belonging to the pressure chamber array 32*a*, i.e., the individual electrodes 54 on the left in FIG. 3, are drawn upstream in the conveying direction from upstream ends of the individual electrodes 54. On the other hand, the wires 55 to the individual electrodes 54 that are arranged to vertically overlap the pressure chambers 32 belonging to the pressure chamber array 32*b*, i.e., the individual electrodes 54 on the right in FIG. 3, are drawn downstream in the conveying direction from downstream ends of the individual electrodes 54.

The bumps 55*a* are each arranged on a side of each wire 55 opposite to the respective individual electrode 54. In particular, the bump 55*a* of the wire 55 to the individual electrode 54 that is arranged to vertically overlap the pressure chamber 32 belonging to the pressure chamber array 32*a*, i.e., the individual electrode 54 on the left in FIG. 3, is arranged on an upstream side of the wire 55, and the bump 55*a* of the wire 55 to the individual electrode 54 that is arranged to vertically overlap the pressure chamber 32 belonging to the pressure chamber array 32*b*, i.e., the individual electrode 54 on the left in FIG. 3, is arranged on a downstream side of the wire 55. The bumps 55*a* may serve to connect the individual electrodes 54 with a driver 64, which will be described further below.

As shown in FIG. 3, the nozzle unit 60 includes a silicon board 63, the driver 64, and electrode pads 67, 68. On a lower face of the silicon board 63, the discharging openings 31 are arranged in two (2) arrays to form discharging opening arrays 31*a*, 31*b*, which extend along the sheet-width direction. The discharging opening arrays 31*a*, 31*b* align side by side along the sheet-width direction. The discharging openings 31 are arrayed at equal intervals along the sheet-width direction.

The discharging openings 31 belonging to the discharging opening array 31*a* are provided to the pressure chambers 32 that constitute the pressure chamber array 32*a*. The discharging openings 31 belonging to the discharging opening array 31*a* are arranged at positions to vertically overlap downstream end areas, i.e., the rightward ends in FIG. 3, of the respective pressure chambers 32 in the conveying direction. The discharging openings 31 belonging to the discharging opening array 31*b* are provided to the pressure chambers 32 that constitute the pressure chamber array 32*b*. The discharging openings 31 belonging to the discharging opening array 31*b* are arranged at positions to vertically overlap upstream end areas, i.e., the leftward ends in FIG. 3, of the respective pressure chambers 32 in the conveying direction.

On an upper face of the silicon board 63, the driver 64 to operate the actuator 50 is arranged. The driver 64 may be a semiconductor circuit formed on the face of the silicon board 63 through a known semiconductor forming process. On the surface of the silicon board 63, on which the driver 64 is formed, a protector sheet (not shown) made of, for example, silicon nitride (SiNx) is arranged to cover the surface of the silicon board 63, on which the driver 64 is formed, including the driver 64, substantially entirely.

The electrode pads 67, 68 are arranged on an upper face of the nozzle unit 60. The electrode pad 67 contacts a ground terminal (not shown) that may supply ground potential from the driver 64. The electrode pad 68 contacts a driving terminal (not shown) that may supply driving potential from the driver 64. As shown in FIG. 3, the electrode pad 67 contacts the tubular electrodes 56, and the electrode pad 68 contacts the bumps 55*a*.

The nozzle unit 60 is connected with the common electrode 52 through the tubular electrodes 56 and the bumps 55*a*. A height of the tubular electrodes 56 and a height of the bumps 55*a*, i.e., dimensions in the vertical direction, are substantially equal. Due to the arrangement of the tubular electrodes 56 and the bumps 55*a*, a clearance is reserved vertically between the nozzle unit 60 and the common electrode 52, and the piezoelectric devices 53 and the individual electrodes 54 are arranged in the clearance. Therefore, when the actuator 50 is operated, the actuator 50 may be restrained from interfering with the nozzle unit 60.

Next, flows of the ink in the inkjet head 3 will be described. Ink in an ink tank (not shown) may be supplied to the supplying manifold 33*a* through the supplying port 21 and to the supplying manifold 33*b* through the supplying port 22. The ink supplied to the supplying manifold 33*a* through the supplying port 21 may flow from the second side toward the first side in the sheet-width direction, i.e., from right to left in FIG. 2, and while flowing leftward in the sheet-width direction, a part of the ink may flow into the pressure chambers 32 that constitute the pressure chamber array 32*a* through the respective supplying flow paths 37. The ink supplied to the supplying manifold 33*b* through the supplying port 22 may flow from the first side toward the second side in the sheet-width direction, i.e., from right to left in FIG. 2, and while flowing leftward in the sheet-width direction, a part of the ink may flow into the pressure chambers 32 that constitute the pressure chamber array 32*b* through the respective supplying flow paths 37. Moreover, a part of the ink flowing into the pressure chambers 32 may flow into the returning manifold 34 through the returning flow paths 38. The ink in the returning manifold 34 may flow from the first side toward the second side in the sheet-width direction, i.e., from left to right in FIG. 2, and return to the ink tank through the returning port 23.

The ink reaching the ends of the supplying manifolds 33*a*, 33*b* on the first side in the sheet-width direction, i.e., the leftward ends in FIG. 2, may flow into the connecting flow path 35. The ink may flow along the circumferential direction of the semicircular-shaped or arched connecting flow path 35 and may flow toward the end of the connecting flow path 35 on the first side, i.e., the leftward end in FIG. 2, in the sheet-width direction.

Meanwhile, as the ink flows out from the ink tank and travels through the flow paths, air may be mixed with the ink, and/or air may be drawn into the flow paths through the discharging openings 31 to be mixed with the ink due to defects caused in the flow paths. The air contained in the ink may reach the supplying manifolds 33*a*, 33*b* and conveyed to the ends of the supplying manifolds 33*a*, 33*b* on the second side, i.e., the leftward ends of the supplying manifolds 33*a*, 3*b*, on the side opposite to the ends, at which the supplying manifolds 33*a*, 33*b* are connected with the supplying ports 21, 22, respectively. In other words, the air may be conveyed to the leftward ends of the supplying manifolds 33*a*, 33*b*, at which the supplying manifolds 33*a*, 33*b* are connected with the connecting flow path 35. The air may therefore flow into the connecting flow path 35 and may be conveyed to the returning manifold 34 through the bypass 36.

<Benefits>

The inkjet head 3 according to the embodiment includes the returning manifold 34, the supplying manifolds 33*a*, 33*b*, the connecting flow path 35, and the bypass 36. The returning manifold 34 extends in the sheet-width direction and is provided commonly to the plurality of individual flow paths 30. The supplying manifolds 33*a*, 33*b* are located on one side and the other side of the returning manifold 34, respectively, in the conveying direction, which intersects orthogonally with the sheet-width direction. The supplying manifold 33*a* is provided commonly to a part of the individual flow paths 30 including the pressure chambers 32 that constitute the pressure chamber array 32*a*. The supplying manifold 33*b* is provided commonly to another part of the individual flow paths 30 including the pressure chambers 32 that constitute the pressure chamber array 32*b*. The connecting flow path 35 partly overlaps the returning manifold 34 in the vertical direction. The connecting flow path 35 connects one end of the supplying manifold 33*a* on the first side in the sheet-width direction and one end of the supplying manifold 33*b* on the second side in the sheet-width direction. The bypass 36 extends in the vertical direction and has the inlet flow path 36*a*, through which the ink enters, at the lower end thereof, and the outlet flow path 36*b*, through which the ink exits, at the upper end thereof. The bypass 36 connects the returning manifold 34 and the connecting flow path 35. Therefore, the supplying manifold 33*a* and the supplying manifold 33*b*, each provided to the different individual flow paths 30, are connected with each other through the connecting flow path 35. Therefore, amounts of the air to retain in the supplying manifolds 33*a*, 33*b* may be restrained from being different largely but may be equalized substantially at a same level. Moreover, due to the arrangement of the bypass 36 that extends vertically, the air may flow upward naturally from the connecting flow path 35 to the returning manifold 34 by the effect of buoyancy. Therefore, retention of the air in the supplying manifolds 33*a*, 33*b* may be restrained.

Moreover, the supplying manifold 33*a* and the supplying manifold 33*b* may supply the ink to the part and the another part of the plurality of individual flow paths 30, respectively. The returning manifold 34 may accept the ink flowing from the supplying manifold 33*a* and from the supplying manifold 33*b*. The connecting flow path 35 may be located at the lower position with respect to the returning manifold 34. In this arrangement, the air flowing through the supplying manifolds 33*a*, 33*b* may move to the returning manifold 34 through the bypass 36. Therefore, retention of the air in the supplying manifolds 33*a*, 33*b* may be restrained.

Moreover, the bypass 36 may be connected with the connecting flow path 35 at the end of the connecting flow path 35 on the first side, i.e., the leftward end in FIGS. 2 and 4, in the sheet-width direction. Therefore, retention of the air at the end of the connecting flow path 35 on the first side in the sheet-width direction may be restrained.

Moreover, the connecting flow path 35 may have the semicircular or arched shape in the plan view, and the length between ends of the connecting flow path 35 in the conveying direction may be smaller toward the end of the connecting flow path, i.e., the leftward end in FIGS. 2 and 4, on the first side in the sheet-width direction. Therefore, retention of the air at the end of the connecting flow path 35 on the first side in the sheet-width direction may be restrained.

Moreover, the returning manifold 34 may have the protrusive portion 34*a*, which protrudes at the upper end of the returning manifold 34 toward the first side in the sheet-width direction, at the end portion thereof, i.e., the leftward side in FIG. 4, on the first side in the sheet-width direction so that the returning manifold 34 may overlap the connecting flow path 35 in the vertical direction at the protrusive portion 34*a*. Moreover, the returning manifold 34 may have the semicircular portion 34*b*, which has the semicircular shape in the plan view, at the end portion thereof on the first side in the sheet-width direction. The bypass 36 may be connected to the returning manifold 34 at the semicircular portion 34*b*. Therefore, retention of the air at the end of the returning manifold 34 on the first side in the sheet-width direction may be restrained.

Moreover, the length of the semicircular portion 34*b* of the returning manifold 34, at which the returning manifold 34 is connected with the bypass 36, along the conveying direction may be, smaller toward the end of the semicircular portion 34*b* on the first side in the sheet-width direction. Therefore, retention of the air at the end of the returning manifold 34 on the first side in the sheet-width direction may be restrained.

Moreover, cross-sectional areas of the supplying manifold 33*a*, the supplying manifold 33*b*, and the connecting flow path 35 on planes intersecting orthogonally with respective flowing directions for the ink may be equal. Therefore, the air may flow from the supplying manifold 33*a* to the connecting flow path 35 and from the supplying manifold 33*b* to the connecting flow path 35 without being caught in intermediate areas.

Moreover, the circulative flow paths 30*a* may be each provided to one of the plurality of individual flow paths 30, and the circulative flow paths 30*a* may each connect the returning manifold 34 with the supplying manifold 33*a* or the supplying manifold 33*b* through the respective one of the of individual flow paths 30. The value of potential resistance in the bypass 36 may be equal to the value of combined potential resistance of the plurality of circulative flow paths 30*a*. Therefore, the ink may flow reliably from the supplying manifolds 33*a*, 33*b* to the returning manifold 34, not only through the bypass 36 but also through the individual flow paths 30.

Moreover, the bypass 36 may be located farther toward the first side, e.g., leftward in FIG. 2, in the sheet-width direction than the ends, i.e., the leftward ends in FIG. 2, of the two discharging opening arrays 31*a*, 31*b* on the first side in the sheet-width direction. The ends, i.e., the leftward ends in FIG. 2, of the supplying manifolds 33*a*, 33*b* in the sheet-width direction, at which the supplying manifolds 33*a*, 33*b* are connected with the connecting flow path 35, may be located between the ends, i.e., the leftward ends in FIG. 2, of the two discharging opening arrays 31*a*, 31*b* on the first side in the sheet-width direction and the bypass 36. Therefore, discharging abilities among the discharging openings 31 belonging to the same one of the discharging opening arrays 31*a*, 31*b* may be restrained from varying.

Although an example of carrying out the invention has been described, those skilled in the art will appreciate that there are numerous variations and permutations of the liquid discharging head that falls within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

Figure 5:
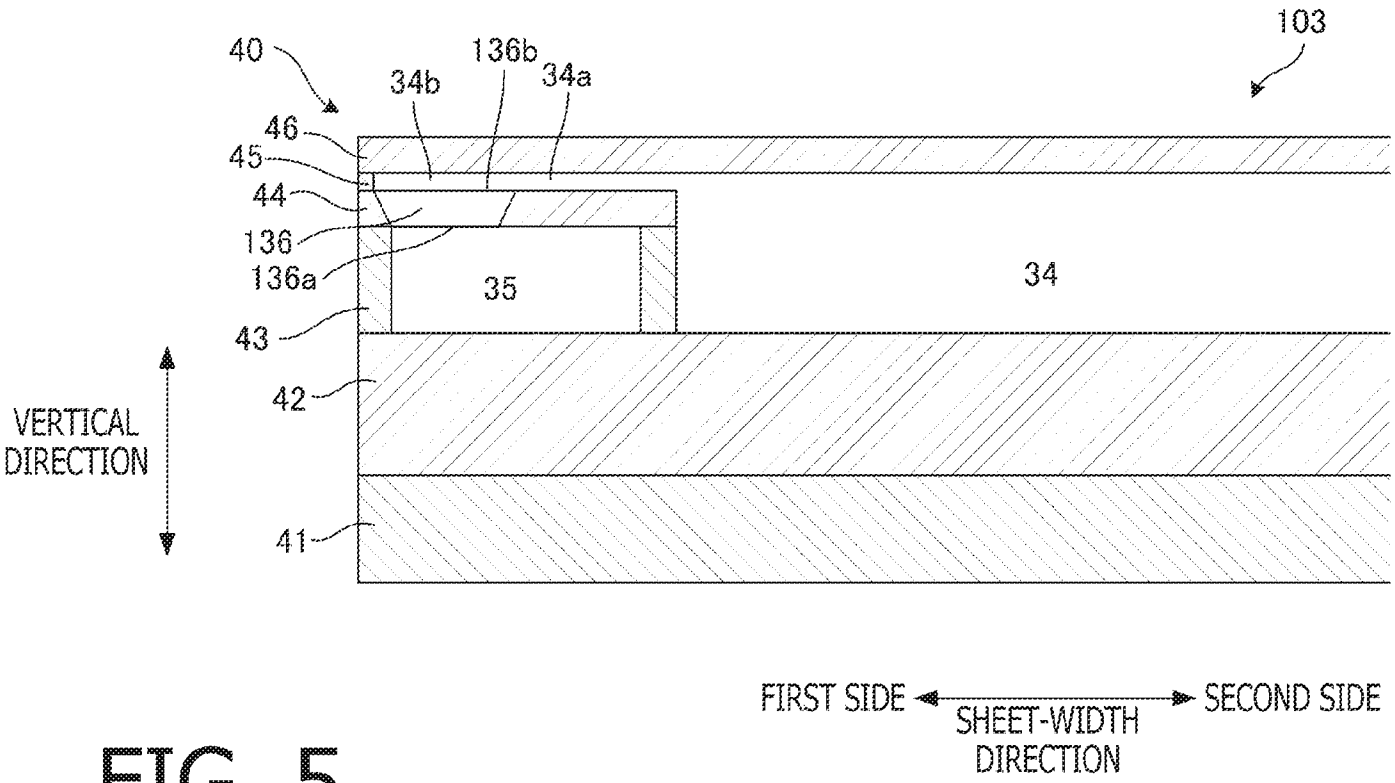
FIG. 5 is a cross-sectional view of a flow path unit in the inkjet head in a first modified example of the embodiment according to the present disclosure.

For example, the cross-sectional area of the bypass 36 on a plane spreading in parallel with the horizontal direction may not necessarily be constant at any vertical position. As shown in FIG. 5, in an inkjet head 103 in a first modified example of the embodiment, a cross-sectional area of a bypass 136 on a plane spreading parallel to the horizontal direction may be smallest at a lower end, where an inlet flow path 136*a* is formed, and may be larger toward an upper end, where an outlet flow path 36*b* is formed, to be largest at the upper end. For example, when a number of the discharging channels in the inkjet head 103 is 864, diameters of the bypass 136 may be 0.18 mm at the lower end and 0.265 mm at the upper end, and a length of the bypass 136 may be 0.5 mm. For another example, when the number of the discharging channels in the inkjet head 103 is 864, diameters of the bypass 136 may be 0.18 mm at the lower end and 0.39 mm at the upper end, and a length of the bypass 136 may be 1.0 mm. In these configurations, the air may flow upward in the bypass 136, and retention of the air in the bypass 136 may be restrained.

For another example, embodiments of the present disclosure may not necessarily be limited to the inkjet heads 3, 103 described above, having the supplying manifold 33*a* provided to the individual flow paths 30 that include the discharging openings 31 belonging to the discharging opening array 31*a*, the supplying manifold 33*b* provided to the individual flow paths 31 that include the discharging openings 31 belonging to the discharging opening array 31*b*, and the returning manifold 34 provided to the individual flow paths 30 that include the discharging openings 31 belonging to the discharging opening array 31*a* and the discharging opening array 31*b*. For an example, an inkjet head 203 as a second modified example of the embodiment of the present disclosure will be described in the following paragraphs.

Figure 6:
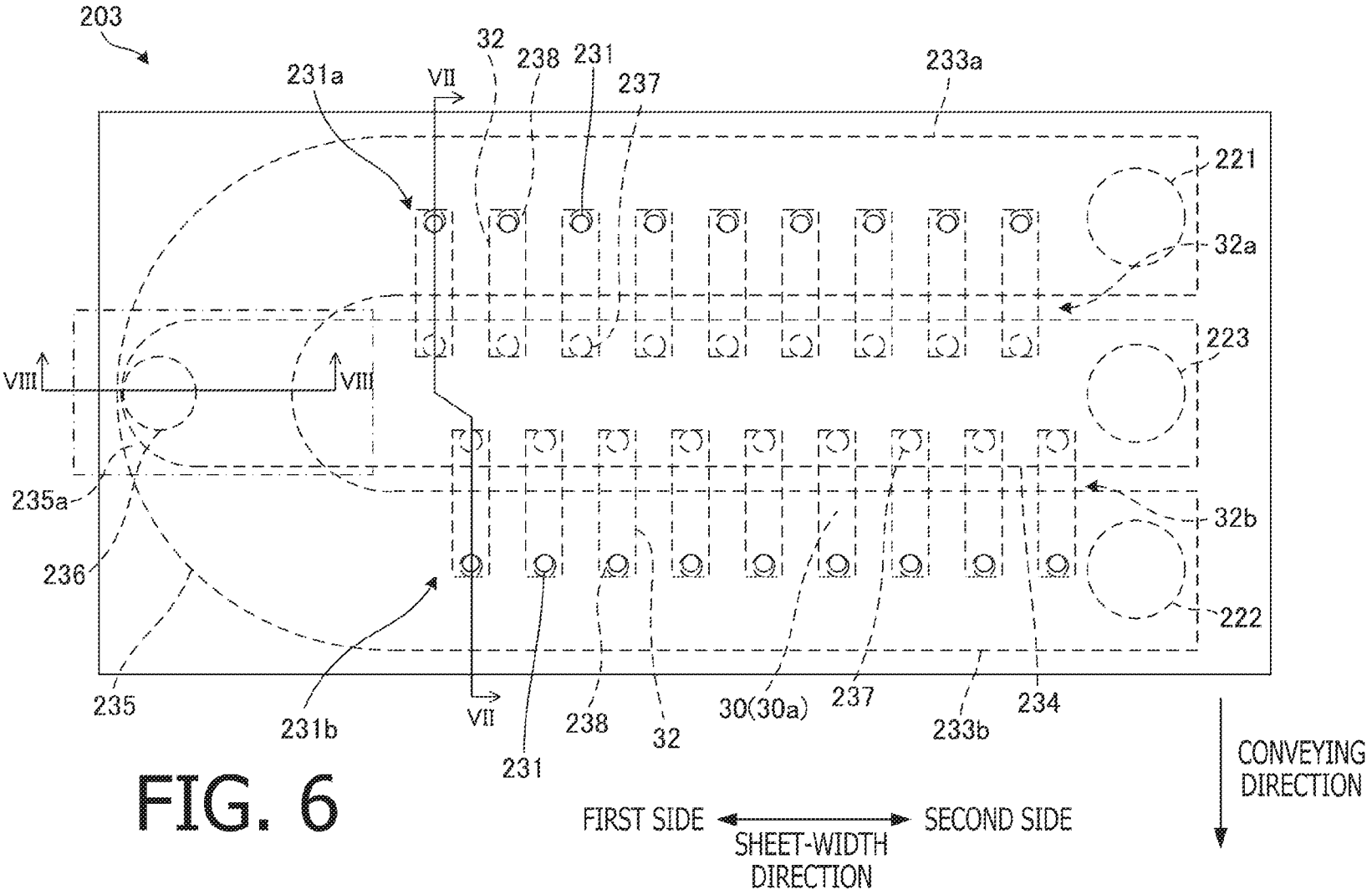
FIG. 6 is a bottom plan view of an inkjet head according to a second modified example of the embodiment of the present disclosure.
Figure 7:
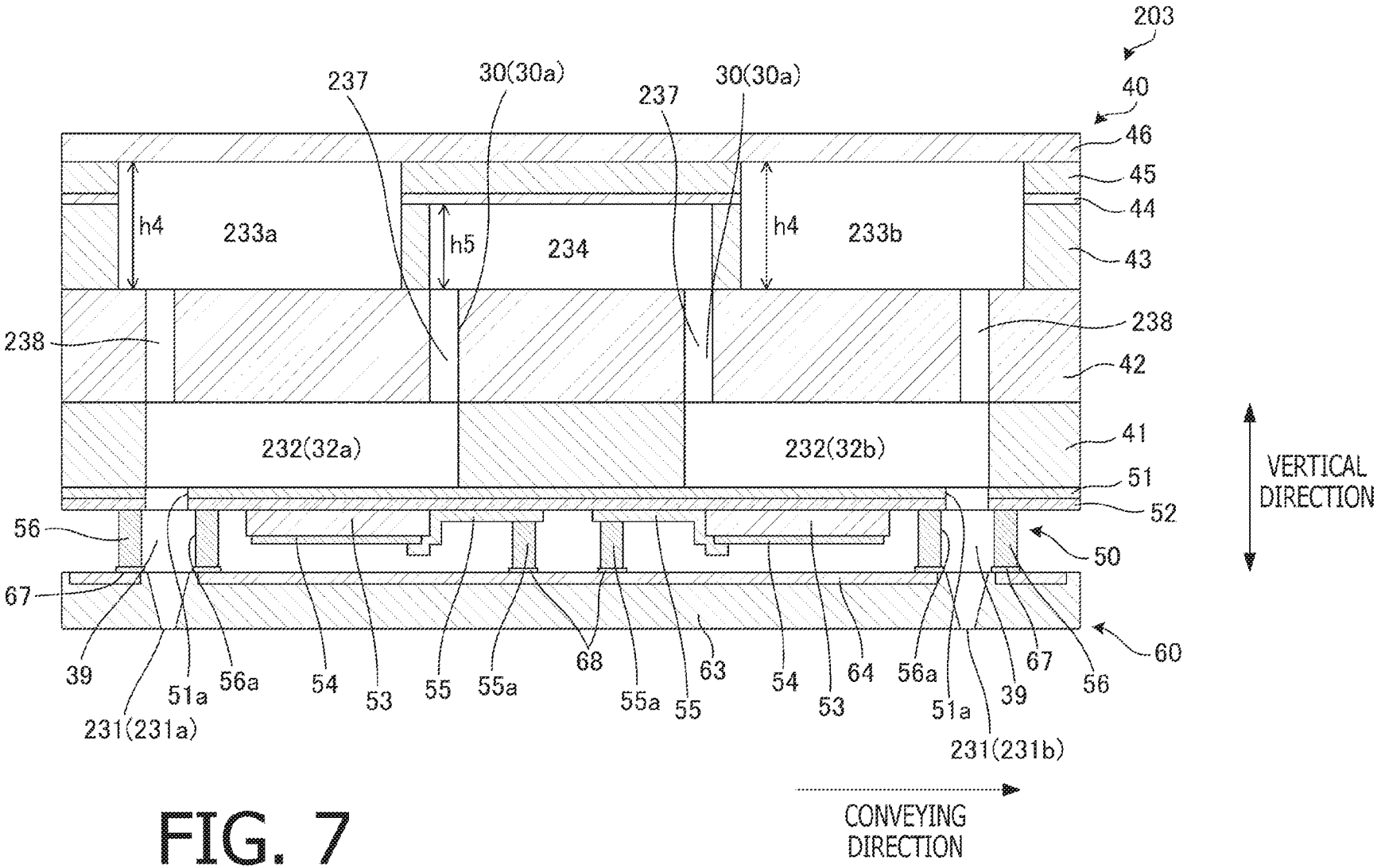
FIG. 7 is a cross-sectional view of the inkjet head according to the second modified example of the embodiment of the present disclosure viewed along a line VII-VII shown in FIG. 6.
Figure 8:
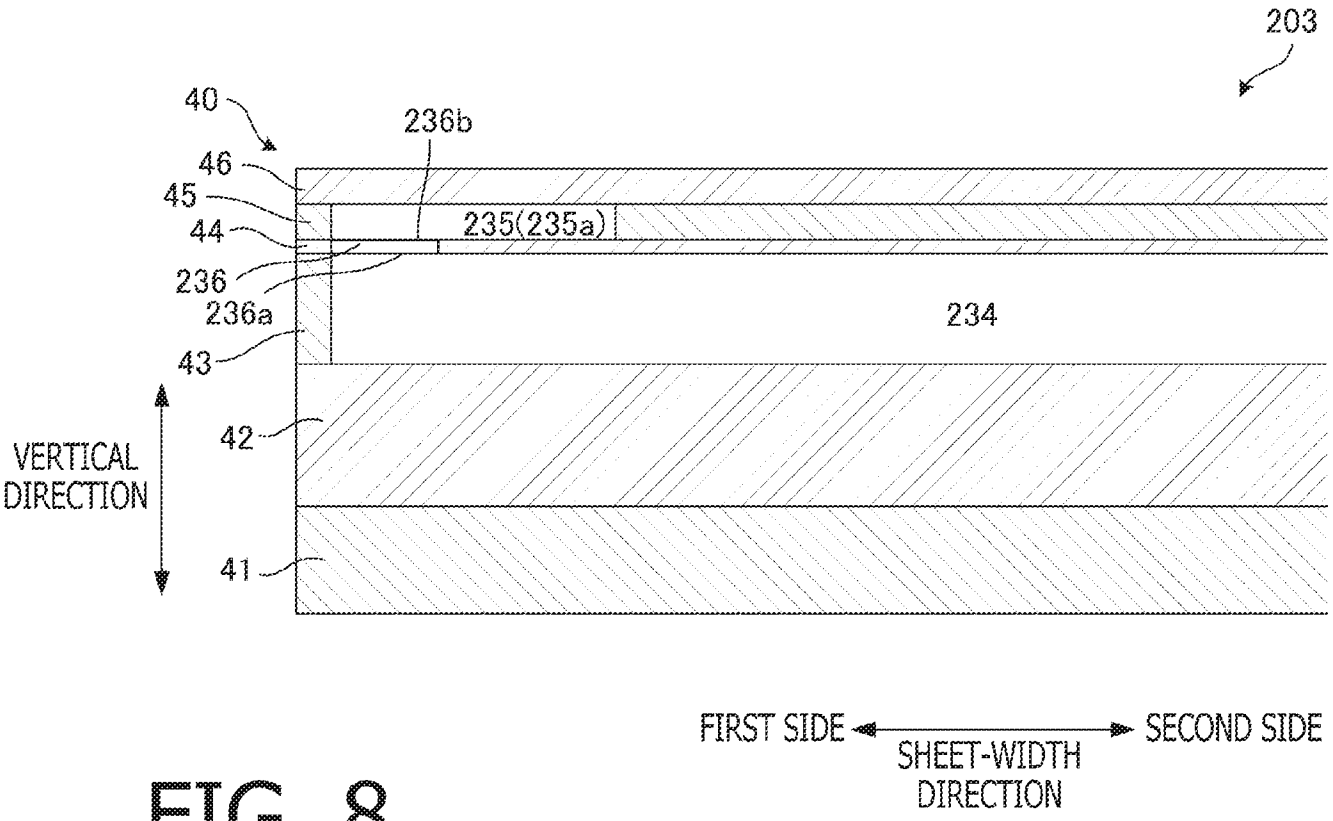
FIG. 8 is a cross-sectional view of a flow path unit in the inkjet head according to the second modified example of the embodiment of the present disclosure viewed along a line VIII-VIII shown in FIG. 2.

As shown in FIGS. 6-8, the inkjet head 203 has a returning manifold 233*a* provided to the individual flow paths 30 that include a plurality of discharging openings 231 belonging to a discharging opening array 231*a*, a returning manifold 233*b* provided to the individual flow paths 30 that include a plurality of discharging openings 231 belonging to a discharging opening array 231*b*, and a supplying manifold 234 provided to the both of the individual flow paths 30 that include the discharging openings 231 belonging to the discharging opening array 231*a* and the discharging opening array 231*b*.

The supplying manifold 234 may supply the ink flowing from a supplying port 223 to all of the individual flow paths 30. The returning manifolds 233*a*, 233*b* may accept the ink flowing from the supplying manifold 234. The ink flowing through the returning manifolds 233*a*, 233*b* may exit through returning ports 221, 222.

The returning manifolds 233*a*, 233*b* and the supplying manifold 234 all extend in the sheet-width direction, and the returning manifolds 233*a*, 233*b* are arranged on one side and the other side of the supplying manifold 234 in the conveying direction, respectively. Ends of the returning manifolds 233*a*, 233*b* on the first side in the sheet-width direction, i.e., the leftward ends in FIG. 6, are connected with a connecting flow path 235.

As shown in FIG. 7, the returning manifolds 233*a*, 233*b* has an equal depth h4, which is larger than a depth h5 of the supplying manifold 234. Lower ends of the returning manifolds 233*a*, 233*b* and the supplying manifold 234 are located at a same vertical level. Meanwhile, upper ends of the returning manifolds 233*a*, 233*b* is located at an upper level with respect to an upper end of the supplying manifold 234. An upper end of the connecting flow path 235 is located at a same vertical level as the upper ends of the returning manifolds 233*a*, 233*b*. A lower end of the connecting flow path 235 is located at the same vertical level as the lower ends of the returning manifolds 233*a*, 233*b*, except a central portion 235*a* located at a center in the conveying direction in the bottom plan view, i.e., a part in an area enclosed by a dash-and-dot line in FIG. 6.

As shown in FIG. 8, a lower end of the central portion 235*a* of the connecting flow path 235 is located at an upper position with respect to the upper end of the supplying manifold 234. The central portion 235*a* of the connecting flow path 235 vertically overlaps the supplying manifold 234. The central portion 235*a* of the connecting flow path 235 is located above an end portion of the supplying manifold 234 on the first side in the sheet-width direction, i.e., the leftward end portion in FIGS. 6 and 8. The bypass 236 extends in the vertical direction to connect the end portion of the supplying manifold 234 on the first side in the sheet-width direction and the central portion 235*a* of the connecting flow path 235. At the lower end and the lower end of the bypass 236, an inlet flow opening 236*a* and an outlet flow opening 236*b* are formed, respectively.

In this arrangement, the returning manifold 233*a* and the returning manifold 233*b*, which are provided to the different individual flow paths 30, are connected with each other by the connecting flow path 235. Therefore, similarly to the embodiment described earlier, amounts of the air to retain in the supplying manifolds 33*a*, 33*b* may be restrained from being different largely but may be equalized substantially at a same level. Moreover, due to the arrangement of the bypass 336 that extends vertically, the air may flow upward naturally from the supplying manifold 234 to the connecting flow path 235 by the effect of buoyancy. Therefore, retention of the air in the supplying manifolds 33*a*, 33*b* may be restrained.

For another example, the bypass 36 in the embodiment described earlier may not necessarily be connected to the connecting flow path 35 at the end of the connecting flow path 35 on the first side in the sheet-width direction. It is preferable the bypass 36 is connected to the connecting flow path 35 at a position closer to the end of the connecting flow path 35 on the first side rather than the other end of the connecting flow path 35 on the second side in the sheet-width direction. In other words, in the bottom plan view in FIG. 2, for example, it is preferable that a center of the bypass 36 is located closer to the end on the first side, i.e., leftward in FIG. 2, in the sheet-width direction than a center of the connecting flow path 35 in the sheet-width direction. However, the position, at which the bypass 36 is connected with the connecting flow path 35, may not necessarily be limited to this arrangement but may be located toward the second side rather than the first side in the sheet-width direction.

Figure 9:
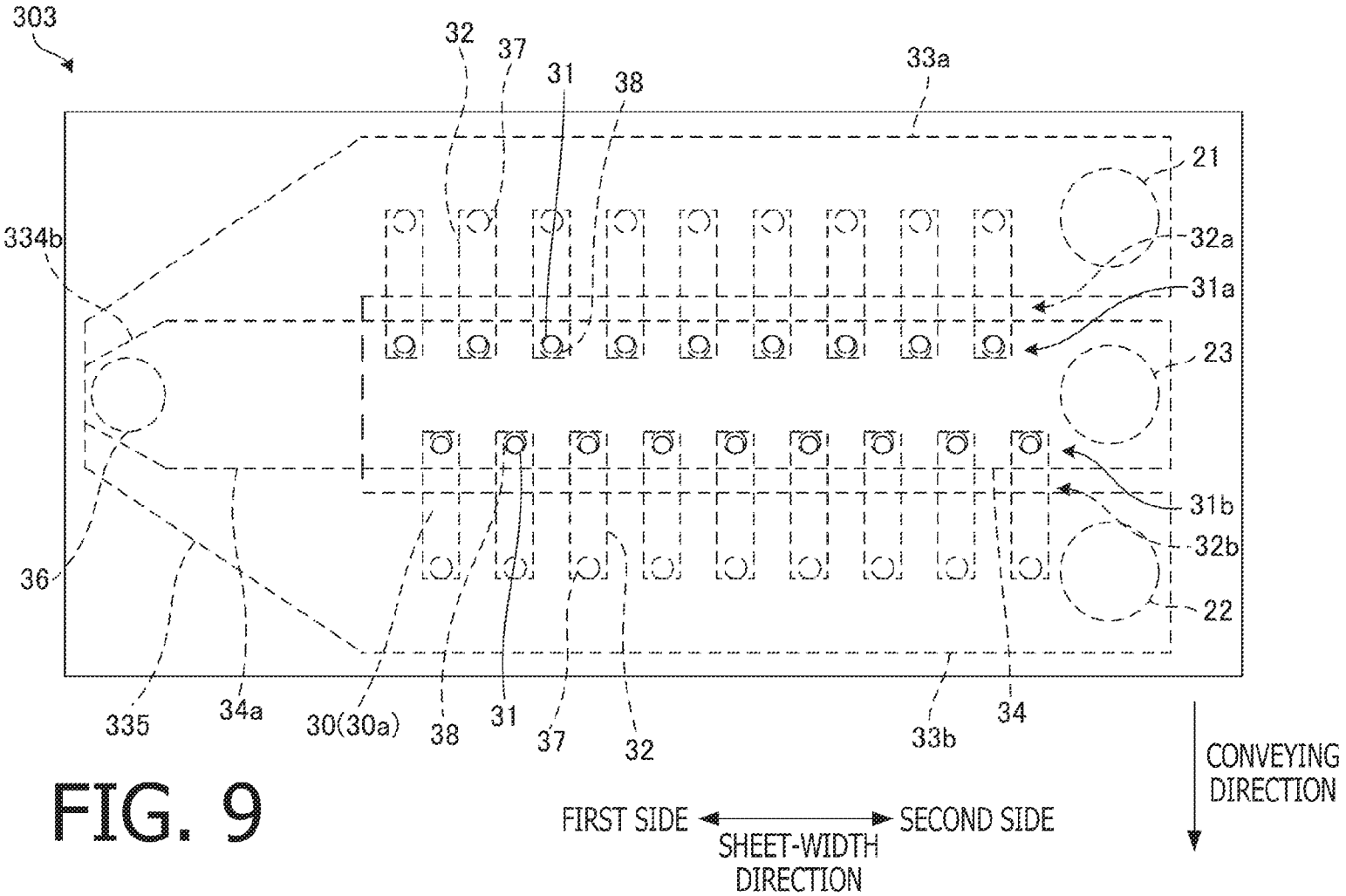
FIG. 9 is a bottom plan view of an inkjet head according to a third modified example of the present disclosure.

For another example, the shape of the connecting flow path 35 may not necessarily be limited to the semicircular or arched shape in the bottom plan view, or the bypass 36 may not necessarily be connected to the returning manifold 34 at the semicircular portion 34*b*. For an example, an inkjet head 303 as a third modified example of the embodiment of the present disclosure will be described below. As shown in a bottom plan view in FIG. 9, a connecting flow path 335 in the inkjet head 303 may have a trapezoidal shape, in which a length between ends of the connecting flow path 335 in the conveying direction is smaller toward the end of the connecting flow path 335 on the first side in the sheet-width direction. Meanwhile, at the end of the protrusive portion 34*a* of the returning manifold 34 on the first side in the sheet-width direction, a trapezoidal portion 334*b* having a trapezoidal shape in the bottom plan view may be arranged. A length of the trapezoidal portion 334*b* in the conveying direction is smaller toward the first side in the sheet-width direction. In other words, a shorter one of the parallel sides in the trapezoid is located on the first side in the sheet-width direction.

Meanwhile, the length between the edges of the connecting flow path 35 or the connecting flow path 335 in the conveying direction may not necessarily be smaller toward the end thereof on the first side in the sheet-width direction but may be constant at each position in the sheet-width direction. For another example, the length between the edges of the protrusive portion 34*a* of the returning manifold 34 in the conveying direction may not necessarily be smaller toward the end thereof on the first side in the sheet-width direction but may be constant at each position in the sheet-width direction.

For another example, the bypass 36 may not necessarily be connected with the returning manifold 34 at the end of the returning manifold 34 on the first side in the sheet-width direction. It is preferable that the bypass 36 is connected to the returning manifold 34 at a part of the returning manifold 34 closer to an end of the returning manifold 34 on the first side in the sheet-width direction rather than the other end of the returning manifold 34 on the second side opposite to the first side in the sheet-width direction within the end portion of the returning flow path 34 overlapping the connecting flow path 35 in the vertical direction. In other words, in the bottom plan view in FIG. 2, for example, it is preferable that the center of the bypass 36 is located toward the first side, i.e., leftward in FIG. 2, in the sheet-width direction than the center of the part of the returning manifold 34 vertically overlapping the connecting flow path 35. However, the position, at which the bypass 36 is connected with the returning manifold 34, may not necessarily be limited to this arrangement but may be located toward the second side rather than the first side in the sheet-width direction within the part of the returning manifold 34 that vertically overlaps the connecting flow path 35.

For another example, the cross-sectional areas of the connecting flow path 35, the supplying manifold 33*a*, and the supplying manifold 33*b* on planes intersecting orthogonally with the flowing direction for the ink may not necessarily be equal but may be different from one another.

For another example, the value of potential resistance in the bypass 36 may not necessarily be equal to the value of the combined potential resistance of the circulative flow paths 30*a* but may be different from the value of the combined potential resistance of the circulative flow paths 30*a*.

For another example, the ends of the supplying manifolds 33*a*, 33*b* in the sheet-width direction, at which the supplying manifolds 33*a*, 33*b* are connected with the connecting flow path 35, may not necessarily be located between the ends of the discharging opening arrays 31*a*, 31*b* in the sheet-width direction on the first side and the bypass 36 but may be located farther from the bypass 36 than the ends of the discharging opening arrays 31*a*, 31*b* on the first side in the sheet-width direction.

For another example, the supplying manifolds 33*a*, 33*b* and the returning manifold 34 may not necessarily extend in parallel with each other in the sheet-width direction, but the supplying manifolds 33*a*, 33*b* and the returning manifold 34 may extend in different directions from each other.

For another example, the actuators may not necessarily be limited to the device to piezoelectrically pressurize the pressure chambers 32 but may be a device that may pressurize the pressure chambers 32 in a different style, such as a thermally pressurizing device with a heating element or an electrostatically pressurizing device using electrostatic force.

For another example, the liquid discharging head may not necessarily be limited to the line-printing head but may be a serially discharging head. For another example, the liquid to be discharged through the nozzle(s) may not necessarily be limited to ink but may be any other liquid. For example, a processing agent to agglutinate or precipitate components in the ink may be discharged. For another example, a discharging target may not necessarily be limited to a sheet P of paper but may be, for example, a piece of fabric or a board.

For another example, the head described in the present disclosure may be applicable not only to a printer but also to, for example, a facsimile machine, a copier, and a multifunction peripheral. Further, the heads described in the present disclosure may be applicable to a liquid discharging apparatus that may be usable in a purpose different from image recording, such as a liquid discharging apparatus to discharge electrically conductive liquid form a conductive pattern on a board.

What is claimed is:

1. A liquid discharging head, comprising:

a plurality of individual flow paths, each of which includes a discharging opening for discharging liquid;

a first manifold extending in a first direction, the first direction intersecting with a vertical direction, the first manifold being provided commonly to the plurality of individual flow paths;

a second manifold located on one side of the first manifold in a second direction, the second direction intersecting orthogonally with the first direction, the second manifold extending in a third direction, the third direction intersecting with the vertical direction and the second direction, the second manifold being provided commonly to a part of the plurality of individual flow paths;

a third manifold located on the other side of the first manifold opposite to the one side in the second direction, the third manifold extending in the third direction, the third manifold being provided commonly to another part of the plurality of individual flow paths;

a connecting flow path partly overlapping the first manifold in the vertical direction, the connecting flow path connecting one end of the second manifold on one side in the third direction and one end of the third manifold on the one side in the third direction; and a bypass extending in the vertical direction, the bypass having an inlet flow path, through which the liquid enters, at a lower end thereof, and an outlet flow path, through which the liquid exits, at an upper end thereof, the bypass connecting the first manifold and the connecting flow path.

2. The liquid discharging had according to claim 1, wherein the second manifold and the third manifold are configured to supply the liquid to the part and the another part of the plurality of individual flow paths, respectively;

wherein the first manifold is configured to accept the liquid flowing from the second manifold and from the third manifold; and wherein the connecting flow path is located at a lower position with respect to the first manifold.

3. The liquid discharging head according to claim 1, wherein the first manifold is configured to supply the liquid to the plurality of individual flow paths;

wherein the second manifold and the third manifold are configured to accept the liquid flowing from the first manifold; and wherein the connecting flow path is located at an upper position with respect to the first manifold.

4. The liquid discharging head according to claim 1, wherein the bypass is connected to the connecting flow path at a position closer to one end of the connecting flow path on the one side in the third direction rather than the other end of the connecting flow path on the other side opposite to the one side in the third direction.

5. The liquid discharging head according to claim 1, wherein a length between ends of the connecting flow path in the second direction is smaller toward one end of the connecting flow path on the one side in the third direction.

6. The liquid discharging head according to claim 1, wherein the first manifold overlaps the connecting flow path in the vertical direction at an end portion thereof on one side in the first direction; and wherein the bypass is connected to the first manifold at a part of the first manifold closer to an end of the first manifold on the one side in the first direction rather than the other end of the first manifold on the other side opposite to the one side in the first direction, within the end portion of the first manifold overlapping the connecting flow path in the vertical direction.

7. The liquid discharging head according to claim 6, wherein a length of the first manifold along the second direction is, at least in the part of the first manifold being connected with the bypass, smaller toward the end of the first manifold on the one side in the first direction.

8. The liquid discharging head according to claim 1, wherein cross-sectional areas of the second manifold, the third manifold, and the connecting flow path on planes intersecting orthogonally with respective flowing directions for the liquid are equal.

9. The liquid discharging head according to claim 1, further comprising:

a plurality of circulative flow paths, each of which is provided to one of the plurality of individual flow paths, each of the plurality of circulative flow paths connecting the first manifold and one of the second manifold and the third manifold through the respective one of the plurality of individual flow paths, wherein a value of potential resistance in the bypass is equal to a value of combined potential resistance of the plurality of circulative flow paths.

10. The liquid discharging head according to claim 1, wherein a cross-sectional area of the bypass on a plane parallel to a horizontal direction is larger toward the upper end thereof.

11. The liquid discharging head according to claim 1, wherein the first direction and the third direction are parallel to each other;

wherein the plurality of discharging openings are arranged in two arrays extending along the first direction;

wherein the second manifold is provided to the part of the plurality of individual flow paths including the discharging openings that belong to one of the two arrays, and the third manifold is provided to the another part of the plurality of individual flow paths including the discharging openings that belong to the other of the two arrays;

wherein the bypass is located farther toward one side in the first direction than ends of the two arrays on the one side in the first direction; and wherein ends of the second manifold and the third manifold in the first direction, at which the second manifold and the third manifold are connected with the connecting flow path, are located between the ends of the two arrays on the one side in the first direction and the bypass.

* * * * *